US008394266B2

(12) United States Patent
Pichon et al.

(10) Patent No.: US 8,394,266 B2
(45) Date of Patent: Mar. 12, 2013

(54) ROLLING CLEANER APPARATUS FOR A SUBMERGED SURFACE WITH A COMBINED HYDRAULIC AND ELECTRIC DRIVE, AND CORRESPONDING METHOD

(75) Inventors: Philippe Pichon, Villeneuve de Riviere (FR); Emmanuel Mastio, Fourquevaux (FR)

(73) Assignee: Zodiac Pool Care Europe, Paris (FR)

( * ) Notice: Subject to any disclaimer, the term of this patent is extended or adjusted under 35 U.S.C. 154(b) by 388 days.

(21) Appl. No.: 12/863,988

(22) PCT Filed: Mar. 25, 2009

(86) PCT No.: PCT/FR2009/050509

§ 371 (c)(1), (2), (4) Date: Sep. 20, 2010

(87) PCT Pub. No.: WO2009/125128

PCT Pub. Date: Oct. 15, 2009

(65) Prior Publication Data

US 2011/0020139 A1 Jan. 27, 2011

(30) Foreign Application Priority Data

Mar. 27, 2008 (FR) ..... 08 01676

(51) Int. Cl.
*E04H 4/16* (2006.01)

(52) U.S. Cl. ..... 210/167.16; 210/232; 210/416.2; 15/1.7; 4/490

(58) Field of Classification Search ..... 210/167.16, 210/167.17, 232, 416.1, 416.2; 15/1.7; 4/490
See application file for complete search history.

(56) References Cited

U.S. PATENT DOCUMENTS

| | | | | |
|---|---|---|---|---|
| 6,502,269 | B1 * | 1/2003 | Balchan et al. | 15/1.7 |
| 7,723,934 | B2 | 5/2010 | Adam et al. | |
| 2003/0201218 | A1 | 10/2003 | Henkin et al. | |
| 2004/0045104 | A1 * | 3/2004 | Pichon | 15/1.7 |
| 2006/0102532 | A1 | 5/2006 | Cadotte, Jr. | |

FOREIGN PATENT DOCUMENTS

| | | |
|---|---|---|
| EP | 1022411 | 7/2000 |
| EP | 1302611 | 4/2003 |
| FR | 2864129 | 6/2005 |
| WO | WO0250388 | 6/2002 |

OTHER PUBLICATIONS

International Search Report in Application No. PCT/FR2009/050509, mailed Nov. 30, 2009.

* cited by examiner

*Primary Examiner* — Fred Prince
(74) *Attorney, Agent, or Firm* — Dean W. Russell; Kilpatrick Townsend & Stockton LLP

(57) ABSTRACT

The invention relates to a rolling cleaner apparatus for a submerged surface, comprising rolling drive members, at least one motor (20*a*, 20*b*) for driving at least one rolling drive member, a filtration chamber formed in the hollow body and having a liquid inlet into the hollow body, a liquid outlet from the hollow body, a hydraulic circuit for circulating liquid between the liquid inlet and the liquid outlet through a filtering device, a motorized pumping device (12) designed to generate a flow of liquid between each liquid inlet and each liquid outlet, characterized in that it comprises a control unit (90) designed to modulate the flow of liquid circulating between each liquid inlet and each liquid outlet.

15 Claims, 5 Drawing Sheets

Figure 1:
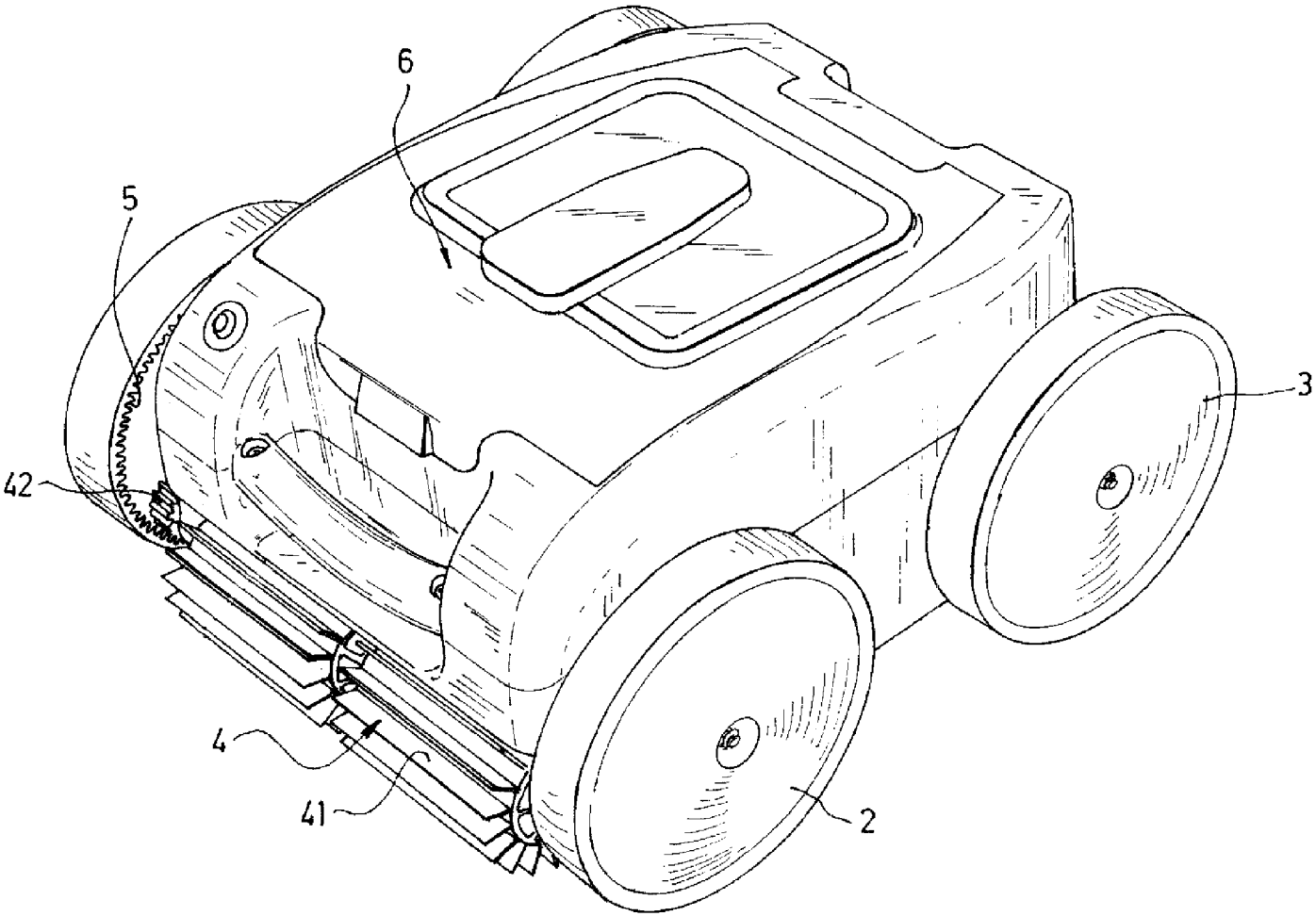

ROLLING CLEANER APPARATUS FOR A SUBMERGED SURFACE WITH A COMBINED HYDRAULIC AND ELECTRIC DRIVE, AND CORRESPONDING METHOD

CROSS REFERENCE TO RELATED APPLICATIONS

This application is the U.S. national phase of International Application No. PCT/FR2009/050509 filed on Mar. 25, 2009 and published on Oct. 15, 2009 as International Publication No. WO 2009/125128 A2, which application claims priority to French Patent Application No. 0801676 filed on Mar. 27, 2008, the entire contents of both of which are incorporated herein by reference.

The invention relates to a rolling device for cleaning an immersed surface, comprising:

- a hollow body,
- rolling members having contact zones with the immersed surface which define a rolling plane of the hollow body over the immersed surface,
- at least one motor for driving at least one rolling member, called the drive rolling member, in order to form a driving device which is capable, via this/these drive rolling member(s), of moving the hollow body over the immersed surface in at least one direction of advance and in a main direction of advance, called the longitudinal direction,
- a filtration chamber which is provided in the hollow body and having:
- at least one liquid inlet into the hollow body, located at the base of said hollow body,
- at least one liquid outlet out of the hollow body, located remotely from the base of said hollow body,
- at least one hydraulic circuit for flow of liquid between at least one liquid inlet and at least one liquid outlet through at least one filtering device,
- at least one motorized pumping device which is at least partially interposed in a hydraulic circuit and which is capable of producing a flow of liquid between each liquid inlet and each liquid outlet which are connected by that hydraulic circuit.

There already exist a number of devices for cleaning with mixed hydraulic and electrical driving. US 2003/0201218 describes such a rolling device for cleaning an immersed surface which comprises drive rolling members which are driven by an electric motor which may further drive a propeller which is capable of producing an outlet flow which is discharged from the device via a rear outlet and produces, by reaction, a force which has a longitudinal drive component which can contribute to driving the device. The rear outlet is further the outlet of the filtering device so that the filtered flow is what contributes to the driving of the device.

One of the disadvantages of this device is that the general architecture of the device is not optimized in order to limit energy consumption. In particular, such a device does not adapt its energy consumption levels to the different situations which it may encounter during cleaning of a pool. For example, the electric drive motor rotates constantly at full power, whatever the behavior of the device and the situation involved. Such a device further does not allow climbing of the vertical walls of a pool, nor the steps of an immersed stairway.

EP 1 022 411 describes a rolling device for cleaning an immersed surface comprising a pumping motor and liquid outlets out of the device. That device is capable of directing at least a portion of a hydraulic flow pumped by the pumping motor towards an outlet of the device. The hydraulic flow is used to bring about changes in forward/backward direction of the device over the immersed surface. EP 1 022 411 sets out that the device may further comprise, in an embodiment which is not described in detail, an electric motor for driving drive rolling members. That device does not have a program allowing optimization of the energy consumption levels in accordance with the situations encountered.

The inventors have established that the known devices which have mixed hydraulic and electrical driving do not efficiently use the specific characteristics of each of those driving methods. In particular, those devices have very unsatisfactory energy results.

The inventors have addressed this problem and have sought to rationalize the energy consumption by a better balance between the driving method used and the state of the device during cleaning of a pool—cleaning the bottom of the pool, cleaning the walls, cleaning the water line, cleaning the bases of walls, changing the direction of the device, encountering an obstacle, etc.

Consequently, an object of the invention is to provide a rolling device for cleaning an immersed surface which has mixed hydraulic and electrical driving whose energy consumption levels are rationalized, that is to say, whose energy consumption levels are adjusted extremely finely to the needs of the device in accordance with its state.

In particular, an object of the invention is to provide a device which has a program for controlling energy allowing, in accordance with each situation encountered by the device, establishment of preferred driving which limits the energy consumption levels whilst optimizing the performance levels of the device.

Another object of the invention is to provide such a device which can use, with performance levels which are equal to or greater than the devices of the prior art, a traction motor of reduced cost.

Another object of the invention is to provide a device which can use hydraulic driving alone, electrical driving alone or mixed driving, in accordance with the situation.

Another object of the invention is to provide a device for cleaning an immersed surface which allows the inclined or vertical walls of a pool, such as a swimming pool, and the immersed stairways to be cleaned, but whose purchase cost and cost of use are reduced, which has greater efficiency and which weighs less than known devices.

Another object of the invention is to provide a rolling device for cleaning an immersed surface whose performance/cost ratio is improved compared with that of prior devices. More specifically, an object of the invention is to provide a device of this type whose cost can be substantially reduced with performance levels which are equivalent to or even greater than those of known devices.

To this end, the invention relates to a rolling device for cleaning an immersed surface comprising:

- a hollow body,
- rolling members having contact zones with the immersed surface which define a rolling plane of the hollow body over the immersed surface,
- at least one motor for driving at least one rolling member, called the drive rolling member, in order to form a driving device which is capable, via this/these drive rolling members, of moving the hollow body over the immersed surface in at least one direction of advance and in a main direction of advance, called the longitudinal direction,
- a filtration chamber which is provided in the hollow body and having:
- at least one liquid inlet into the hollow body, located at the base of said hollow body, at least one liquid outlet out of the hollow body, located remotely from the base of said hollow body, at least one hydraulic circuit for flow of liquid between at least one liquid inlet and at least one liquid outlet through at least one filtering device, at least one motorized pumping device which is at least partially interposed in a hydraulic circuit and which is capable of producing a flow of liquid between each liquid inlet and each liquid outlet which are connected by that hydraulic circuit, at least one liquid outlet which is called the rear outlet being orientated towards the rear in such a manner that the liquid flow which is discharged via that rear outlet produces, by means of reaction, forces whose resultant, called the hydraulic reaction force, has a longitudinal component for driving the device forwards which is not equal to zero, characterized in that it comprises:

a device for detecting at least one signal, which is called an instruction signal and which is representative of a predetermined state of the device, a control unit which is capable of controlling modulation of the liquid flow which is discharged from at least one rear liquid outlet, the modulation having the effect of modulating the hydraulic reaction force and the longitudinal drive component brought about by the flow of liquid which is discharged from that rear outlet, in accordance with the value of at least one instruction signal which is detected by said detection device.

The inventors have established that, in a large number of situations, a modulation of the liquid flow being discharged from at least one rear liquid outlet—in particular from each rear liquid outlet—and more particularly a modulation of the liquid flow flowing between each liquid inlet and each liquid outlet allows modification of the hydraulic contribution to driving the device over the immersed surface, and does not impair the cleaning performance levels of the device.

In practice, the modulation of the liquid flow results from modulation of the instantaneous power provided by at least one electric pumping motor of a pumping device, which therefore allows a reduction in the general electrical consumption of the device. In this manner, in a large number of situations, a device according to the invention consumes less energy whilst having optimum cleaning performance levels.

A control unit of a device according to the invention is capable of processing the signals detected by the detection device and controlling modulation of the liquid flow in accordance with those signals, that is to say, in accordance with the results of the processing operations for those signals carried out by the control unit.

In an advantageous embodiment, the device comprises a single hydraulic circuit with a single rear outlet, and a single electric pumping motor which drives a single pump. A device according to the invention can therefore be controlled in such a manner that the pump produces a liquid flow which is variable in accordance with the state of the device. This state is established by a device for detecting at least one signal, which is called the instruction signal and which is representative of the device state.

Such a detection device may comprise sensors which are capable of detecting the movement of the device at the water line, sensors which are capable of detecting blockage of the device against a bottom plug of a pool, against a vertical wall, and generally any type of means capable of revealing a remarkable state of the device during cleaning of a pool. The contribution of the pumping device to the driving of the device particularly depends on the position of the liquid outlets, the shape of the fairings of the liquid outlets and the position of the pumping device relative to those liquid outlets.

Advantageously, according to the invention, the control unit is capable of controlling a modulation of the liquid flow which is pumped by the pumping device and which flows between each liquid inlet and each liquid outlet.

Advantageously, according to the invention, said control unit is further capable of controlling modulation of the liquid flow which is discharged from at least one rear liquid outlet in such a manner that said flow has a value selected from at least two separate values different from a zero flow rate. That means that the flow resulting from the modulation of the liquid flow may have: at least a first liquid flow value corresponding to a maximum flow value and a maximum power of the pumping motor; at least a second liquid flow value which is dedicated, for example, to a first situation encountered by the device, such a flow being able to be, for example, in the order of 50% of the maximum flow and to correspond to a power of the pumping motor in the order of 50% of the maximum power of the pumping motor; and at least a third liquid flow value which is dedicated, for example, to a second situation encountered by the device, such a flow being able to be, for example, in the order of 20% of the maximum flow and to correspond to a power of the pumping motor in the order of 20% of the maximum power of the pumping motor.

In a variant, the control unit may be capable of controlling modulation of the liquid flow being discharged from at least one rear liquid outlet, in a continuous range of values, said liquid flow being able to take up any value in that range in accordance with the state of the instruction signal. In other words, in this variant, the control unit is capable of controlling an analogue type modulation. In this manner, in this variant, the control unit may allow continuous modulation of the liquid flow in such a manner that the flow being discharged from said rear liquid outlet may have all the values between a zero flow rate corresponding to a stopped pumping motor and a maximum flow rate corresponding to a pumping motor at full power.

Advantageously, according to the invention, at least one rear outlet is orientated in such a manner that said hydraulic reaction force has a component, which is called the vertical component and which is not zero, for driving the device towards the immersed surface, the liquid flow which is discharged via that rear outlet being inclined relative to the horizontal (that is to say, relative to the rolling plane) so as to also create a hydraulic reaction force which has such a non-zero vertical component for driving the device downwards, that is to say, towards the immersed surface.

To that end, in an advantageous embodiment and according to the invention, the axis of rotation of the pumping propeller is inclined relative to the longitudinal direction and extends in a longitudinal plane which is orthogonal to the rolling plane. In other words, the axis of rotation of the pumping propeller is contained in a longitudinal plane which is orthogonal to the rolling plane and forms an angle which is different from 0° and 90° relative to the rolling plane.

A device which is provided with such a liquid outlet may have a large number of programs specific to a number of situations commonly encountered during normal operation of a cleaning device in a pool, such as a swimming pool. In particular, when such a device encounters a vertical wall at the end of a trajectory over a horizontal or substantially horizontal wall, the front drive members of the device are pressed against that vertical wall owing to the longitudinal component of the hydraulic reaction force, so that the front of the device rises along the vertical wall. Consequently, the drive members which are associated with the hydraulic flow allow the device to climb along the vertical wall. In such a situation, it is advantageous to ensure that the device does not emerge too far above the water line of the pool in order to prevent it from drawing in air. According to the invention, the power of the pumping device may be modulated, and in particular reduced, which allows the climbing speed to be limited, particularly in the region of the water line. To that end, for example, the device may comprise a pressure sensor or any equivalent means which allows an estimate of the position of the device relative to the water line. Furthermore, a device according to the invention, once it has reached the water line, may be moved towards the bottom of the pool whilst remaining pressed against a wall of the pool with the power of the pump being reduced, which reduces the hydraulic jet at the rear of the device and thereby allows the device to descend again towards the bottom of the pool under the effect of its own weight. The reduction in the power of the pump reduces the energy consumption. The drive rolling members can further be completely stopped in this configuration, which further reduces energy consumption levels.

A device according to the invention also allows control in a particularly effective manner when passing stair nosings, that is to say, related junction edges between a vertical wall and a horizontal wall. In this manner, advantageously and according to the invention, said control unit is capable of modulating the hydraulic reaction force by modulating the liquid flow which is discharged from at least one rear liquid outlet so as to bring about, when each drive rolling member of the device is disengaged from the immersed surface, a pivoting moment of the device about an axis parallel with the rolling plane—in particular a transverse axis—which tends to return each drive rolling member of the device into contact with the immersed surface.

Thus, in the same manner as for an encounter with a vertical wall, the longitudinal component of the hydraulic jet ensures the positioning of the drive rolling members against the walls in such a manner that the device climbs against the vertical wall. When the drive rolling members are detached from the vertical wall and therefore do no longer allow the device to be driven, the hydraulic driving provides the power necessary to allow pivoting of the device in the direction for returning the rolling members thereof into contact with the horizontal wall forming the stair nosing. The power of the hydraulic jet that is determined by the modulated power of the pump allows complete control of the pivoting angle and adaptation of the reaction of the device to any type of configuration. In this manner, a device according to the invention can readily overcome the nosings of stairs, limiting energy consumption levels and gently ensuring precise returns into contact, which are not liable to damage the device.

The modulation of the power of the pumping device therefore confers new functionalities on a device according to the invention.

The variation in the pumping power of the pumping device which determines the power of the hydraulic outlet jet of the device and therefore the hydraulic reaction force (and in particular the longitudinal drive component) can be calculated by the control unit by any known means. Advantageously, a device according to the invention comprises a pumping device comprising an electric pumping motor and the control unit is capable of modulating the power of the electric pumping motor so as to modulate the liquid flow flowing between each liquid inlet and each rear liquid outlet which allows a modulation of the hydraulic reaction force. Such control may be control in terms of voltage, current, frequency, etc. In a variant or in combination, nothing prevents the provision that the control unit can modulate a variation in cross-section of at least one rear liquid outlet, for example, by a butterfly type solenoid valve which is interposed at that rear liquid outlet, or the like. The control unit is preferably arranged on the device.

The liquid flow which flows in the device is directly representative of the hydraulic reaction force. As has been seen, the modulation of the liquid flow may serve to optimize overcoming the stair nosing, control of the descent of a device from the water line towards the bottom of the pool, etc.

Advantageously and according to the invention, said control unit is capable of modulating the hydraulic reaction force by modulating the liquid flow pumped by the pumping device when the device climbs along a vertical wall so as to limit the ascent speed of the device.

Advantageously and according to the invention, said control unit is capable of modulating the hydraulic reaction force by modulating the liquid flow pumped by the pumping device when the device is at the water line so as to allow the device to descend towards the immersed surface opposite the water line.

It should be noted that, in a device according to the invention, each rear liquid outlet is adapted so that the longitudinal drive component of the hydraulic reaction force is parallel with the main direction of longitudinal advance of the device as defined by the rolling members and each associated drive motor. Similarly, the control unit is adapted so that the modulation of the flow being discharged from each rear liquid outlet does not modify the direction of the longitudinal drive component, that is to say, does not itself bring about a change in direction of advance of the device. In particular, the control unit is advantageously capable of bringing about progressive modulation of the flow, without any abrupt changes or sudden interruptions.

Advantageously and according to the invention, said control unit is also capable of controlling each drive motor of each drive rolling member. In particular, said control unit is capable of minimizing the power consumed by each drive motor.

Preferably, the power of each drive motor can also be modified at the control of the control unit so as to adapt the drive speed of the device to situations encountered and to needs. For example, a device according to the invention may comprise an "economical" program, in which the power of the drive motors is limited so as to reduce the energy consumption levels. A device according to the invention may also comprise a "rapid" program, in which the drive motors are actuated at full power so as to allow rapid cleaning of the pool.

A device according to the invention may also comprise a "precise" program, in which the pumping motors are actuated at full power so as to allow careful cleaning of the pool.

The situations in which the device can reduce the pumping power and/or the drive power of the drive rolling members are established by the detection device of at least one instruction signal representing a state of the device.

According to a variant of the invention, the detection device comprises various sensors, such as contact sensors, pressure sensors, etc., which are capable of detecting one or more predetermined state(s) of the device.

Advantageously, said detection device comprises at least one wall sensor which is connected to the control unit and which is capable of detecting the presence of a vertical wall.

Such a sensor is, for example, a contact sensor which is mounted at the front of the device. Such a contact sensor may be of any known type. Such a wall sensor may also be an electronic sensor which is capable of periodically measuring a variable which represents the load moment of at least one drive rolling member and comparing this value with a predetermined value representing the maximum value permissible. Exceeding the value may indicate that the device is blocked against a front or rear wall depending on the direction of advance of the device. According to another variant, a contact sensor may be an electronic sensor which measures the inclination of the device.

Advantageously, a device according to the invention comprises a front axle which carries at least one drive rolling member which is mounted for rotation relative to the hollow body about a transverse axis.

Advantageously and according to the invention, the front axle carries two drive rolling members which are mounted at each of the ends of the axle, respectively, each drive rolling member being driven in rotation by an electric drive motor.

Advantageously and according to the invention, said pumping device comprises an electric pumping motor which comprises a rotating drive shaft which is coupled to an axial pumping propeller interposed in a hydraulic circuit whose axis of rotation is inclined relative to the longitudinal direction.

The invention also extends to a method for controlling a device for cleaning an immersed surface according to the invention.

To that end, the invention relates to a method for controlling a device for cleaning an immersed surface according to the invention, in which:

at least one motorized pumping device of the device is actuated, at least one drive motor of at least one rolling member of the device is actuated, characterized in that the power of the pumping device is modulated at the control of a control unit as soon as a signal, called the instruction signal, is detected by a device for detecting a signal representing a predetermined state of the device.

The invention also relates to a rolling device for cleaning an immersed surface and a method for controlling the device, characterized in combination by all or some of the features set out above or below.

Figure 2:
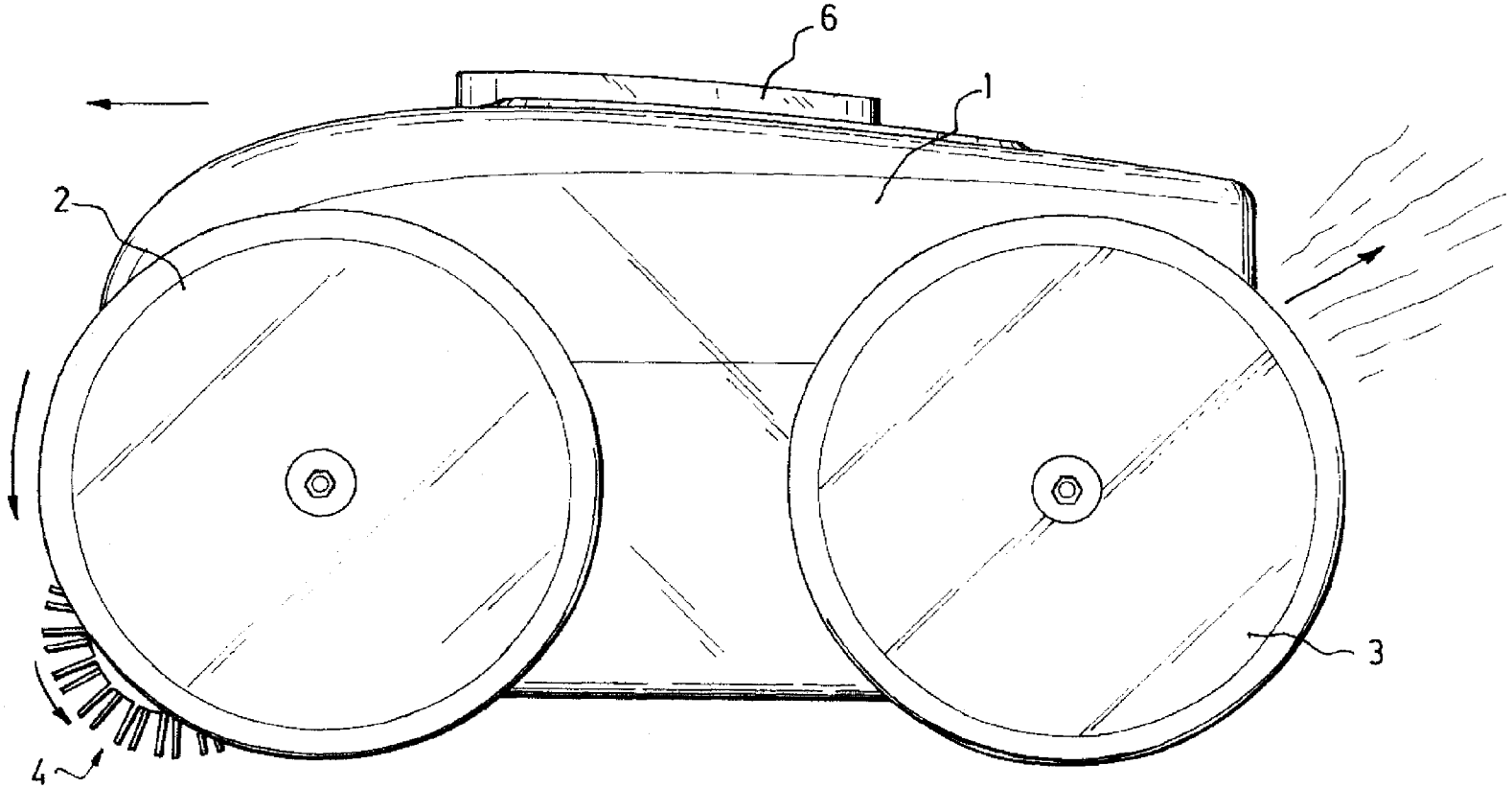
Figure 3:
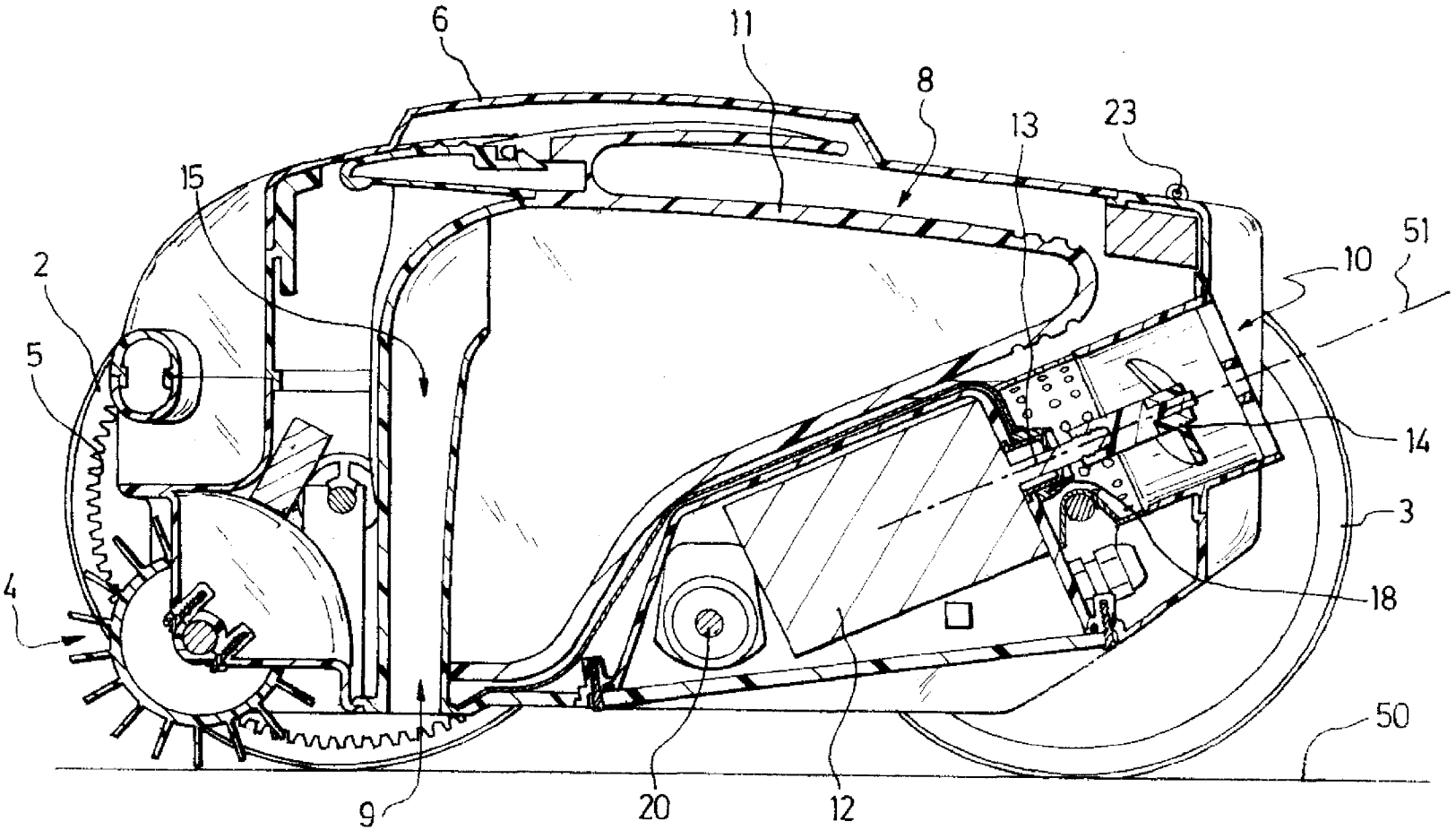
Figure 4:
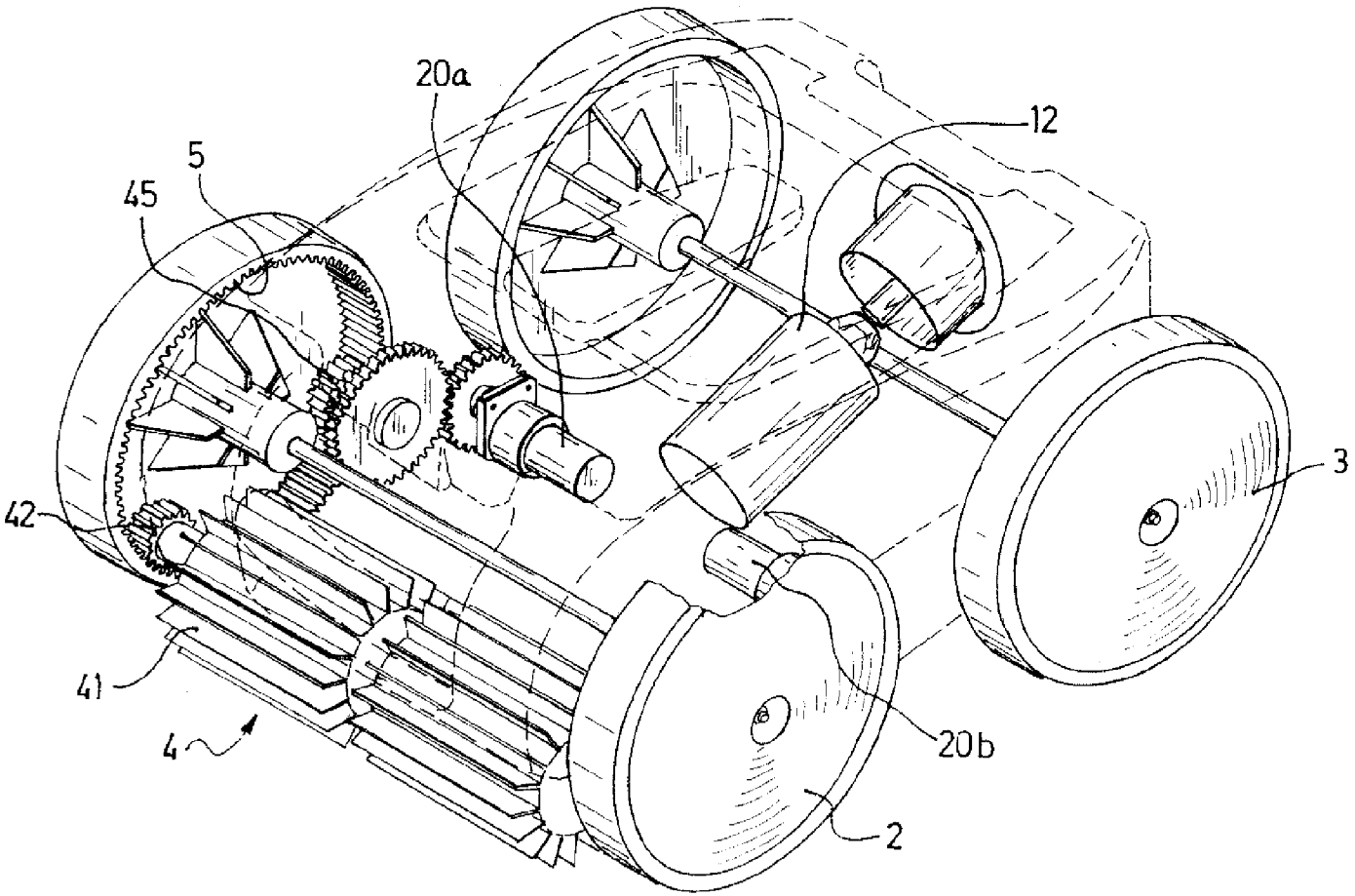
Figure 5:
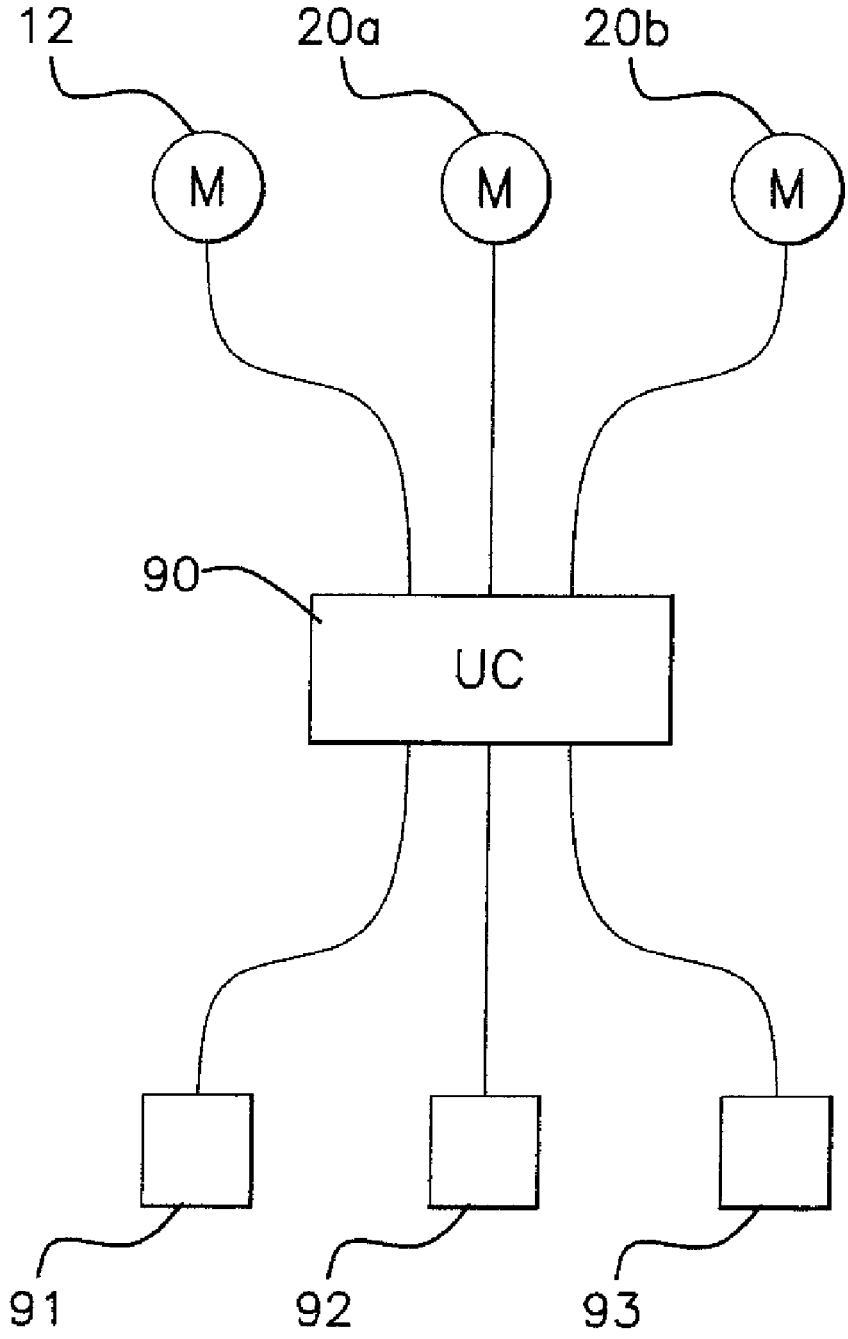

Other objects, features and advantages of the invention will be appreciated from a reading of the following description, which is given purely by way of non-limiting example and with reference to the appended Figures, in which:

FIG. 1 is a schematic perspective view of a rolling cleaning device according to one embodiment of the invention, FIG. 2 is a schematic profile view of the device of FIG. 1, FIG. 3 is a schematic section in a vertical, longitudinal plane of the device of FIG. 1, FIG. 4 is a schematic, perspective view of the interior of a device according to the invention, FIG. 5 is a schematic view of the control principle of a cleaning device according to the invention.

In the Figures, the scales and the proportions are not strictly complied with for the purposes of illustration and clarity.

In the whole of the following detailed description with reference to FIGS. 1 to 4, unless otherwise indicated, each component of the cleaning device is described as it is arranged when the device is moving normally over an immersed horizontal surface in accordance with a preferred direction of advance.

A device according to the invention comprises a hollow body 1 and rolling members 2, 3, 4 for guiding the hollow body 1 over an immersed surface in at least a preferred direction of advance and in a main direction of advance, which is called the longitudinal direction and which is parallel with the immersed surface.

This hollow body 1 is formed mainly by a concave housing which delimits a main chamber. That concave housing is, for example, constructed by molding or rotational molding. That housing is preferably constructed from a thermoplastic material, such as polyethylene, polypropylene, ABS, PMMA or any equivalent material.

That hollow body 1 has a central chamber which is capable of receiving a filtration chamber. That central chamber is delimited by a lower wall which extends in a substantially horizontal plane; by lateral walls which generally extend in vertical planes; by a front wall which generally extends in a vertical plane, orthogonal relative to the planes of the vertical lateral walls; and by a rear wall which generally extends in a vertical plane orthogonal relative to the planes of the vertical lateral walls.

The lower wall has an opening which extends transversely in the region of the front wall so that liquid can return to the central chamber via this lower transverse opening.

The rear wall comprises a cylindrical opening. In this manner, the cylindrical opening which is provided in the rear wall of the housing is longitudinally offset from the lower transverse opening which is provided in the lower wall. Furthermore, this cylindrical opening is provided in the upper portion of the housing in such a manner that it is also vertically offset from the lower transverse opening.

As illustrated in particular in FIG. 3, this hollow body 1 comprises a filtration chamber 8 which has a liquid inlet 9 located at the base of the hollow body 1, that is to say, in the lower portion of the device, a liquid outlet 10 which is arranged opposite the base of the body 1, that is to say, in the upper portion of the device, and a hydraulic circuit which is capable of providing a flow of liquid between the liquid inlet 9 and the liquid outlet 10 through a filtering device 11.

The transverse opening which is provided in the lower wall of the housing forms the liquid inlet 9 of the device and the cylindrical opening which is provided in the rear wall of the device forms the liquid outlet 10 of the device.

Preferably, the liquid inlet 9 and the liquid outlet 10 are longitudinally offset but are both centered on the same longitudinal vertical center plane of the device.

The central chamber of the hollow body 1 is capable of receiving the filtering device 11. The filtering device 11 is arranged between the liquid inlet 9 and the liquid outlet 10.

This filtering device 11 may be of any known type.

For example, the filtering device 11 comprises a rigid frame and a filtering material carried by this rigid frame. Such a filtering device 11 is therefore self-supporting and can be readily handled by a user.

The device also comprises a flap 6 for access to this filtering device 11. This access flap 6 forms an upper wall of the hollow body 1 and covers it. In the embodiment illustrated, this flap 6 is provided on the upper portion of the device so that a person using the device can readily open the flap 6 and remove the filtering device 11. The access flap 6 is articulated to the body 1 of the device by means of hinges 23 which are provided at the rear of the device.

In the preferred embodiment illustrated in the Figures, the rolling members 2, 3, 4 for guiding and driving the device comprise a front axle which comprises front drive wheels 2, one at each side, and a rear axle which comprises rear non-drive wheels 3, one at each side.

Furthermore, preferably and as illustrated in the Figures, the device comprises brushes 4 which are arranged at the front of the device. These brushes 4 are intended to brush the immersed surface and move the debris which are brushed towards the rear of the device in the direction of the liquid inlet 9 which is provided below the device.

These brushes 4 may be of any type. According to one embodiment of the invention, the device comprises two coaxial front brushes 4. Each brush 4 is capable of being rotated about an axis which extends in a direction, which is called the transverse direction and which is perpendicular relative to the longitudinal direction. Each brush 4 comprises a plurality of fins 41 which extend radially from a brush shaft which forms the rotation axis of the brush 4. The fins 41 are, for example, of rubber or a strong plastics material.

The device further comprises at least one electric motor 20 for driving the front drive wheels 2. Preferably, the device comprises two drive motors 20*a*, 20*b*, one at each side, for independently driving each of the front wheels 2, respectively. To this end, each front wheel 2 has an internal toothed arrangement 5 which co-operates with a pinion 45 which is driven by the corresponding drive motor 20*a*, 20*b*.

The brushes 4 are preferably also rotated by means of at least one electric motor 20, 20*a*, 20*b* for driving the front wheels 2 by means of a gear system. According to this embodiment, the internal toothed arrangement 5 of each front drive wheel 2 co-operates with a pinion 42 which is fixed to one end of the shaft of a brush 4 so that a rotation of the wheel 2, by means of the toothed arrangement 5 and the pinion 42, brings about the rotation of the shaft of the brush 4 and therefore the rotation of the brush 4.

In this manner, in the embodiment illustrated, the rolling members are constituted by the front drive wheels 2, rear non-drive wheels 3 and brushes 4 which are involved in driving and guiding the device over the immersed surface. In any case, the rolling members 2, 3, 4 have zones which are intended to come into contact with the immersed surface and which are coplanar and define a theoretical rolling plane 50. The longitudinal direction of advance of the device is parallel with this theoretical rolling plane 50.

The front wheels 2 preferably have a diameter of between 100 mm and 500 mm, in particular between 150 mm and 250 mm. According to the embodiment of the Figures, the front wheels 2 have a diameter in the order of 200 mm. In this manner, these front wheels 2 facilitate the passing of obstacles and have improved traction. Advantageously, their peripheral tread is formed by or covered with an anti-skid material.

The front wheels 2 and the brushes 4 constitute front drive rolling members 2, 4 which protrude forwards relative to the other constituent elements of the device, in particular the hollow body, in order to form the extreme front portion of the device and first come into contact with an obstacle which is encountered during the forward movement, for example, a vertical wall.

A device according to the invention comprises a motorized liquid pumping device which comprises an electric pumping motor 12 which has a rotating drive shaft 13 which is coupled to an axial pumping propeller 14 which is rotated by the motor 12 about an axis 51. The propeller 14 is interposed in the hydraulic circuit in order to generate therein a flow of liquid between the liquid inlet 9 and the liquid outlet 10. The liquid outlet 10 is directly opposite the pumping propeller so that the liquid flows out of the liquid outlet 10 in a direction which corresponds to the liquid flow generated by the pumping propeller, this flow having a speed which is orientated in accordance with the rotation axis 51 of the propeller 14.

The pumping propeller 14 has an orientation which allows a flow of liquid to be generated with a horizontal component towards the rear.

Preferably, the pumping propeller 14 has an inclined rotation axis which forms, with said longitudinal direction and with the theoretical rolling plane 50, an angle $\alpha$ which is not equal to 90°. This propeller 14 is rotated by the pumping motor 12 which preferably has a rotating drive shaft 13 which is parallel with the rotation axis of the propeller 14.

According to the invention, the pumping motor 12 is arranged below the hydraulic circuit, entirely at the outer side of this hydraulic circuit which completely bypasses the pumping motor 12 at the top. The rotating shaft 13 of the pumping motor 12 extends through a lower inclined wall which delimits the hydraulic circuit. The sealing is provided by an O-ring 18. In this manner, the filtering device 11 of the hydraulic circuit can be removed from the device via the top of the device as mentioned above, without being impeded by the pumping motor 12. Only the pumping propeller 14 is arranged in the hydraulic circuit so as to be able to provide the liquid flow. This pumping propeller 14 is arranged at the rear of the device, close to the liquid outlet 10. That is to say, the pumping propeller 14 and the liquid outlet 10 form the end portion of the hydraulic circuit. Liquid passes into the hollow body 1 via the liquid inlet 9 arranged below the device. That liquid passes into a liquid intake column 15 in order to reach the filtering device 11. This filtering device 11 allows the liquid to pass via the filtering material and retains the solid debris. The filtered liquid reaches the liquid outlet 10 and is discharged at the rear of the device into the pool from which it originates.

Since the liquid outlet 10 is opposite the pumping propeller 14, the liquid flows out of the device via this outlet with a speed V which is orientated along the axis 51 of the pumping propeller 14 and which has a longitudinal component towards the rear which brings about, by means of reaction, forces whose resultant, called the hydraulic reaction force Fe, has a longitudinal drive component Fe which is orientated towards the front and which is involved in driving the device over the immersed surface.

The orientation of the hydraulic reaction force Fe produced by that outlet flow and therefore the size of the longitudinal component Fel thereof are dependent on the inclination $\alpha$ relative to the theoretical rolling plane 50, the rotation axis 51 of the propeller and the liquid outlet 10. Preferably, this inclination $\alpha$ is between 15° and 45°. The rolling plane 50 is the theoretical plane which is defined by the contact zones of the rolling members 2, 3, 4 with the immersed surface. That rolling plane 50 is horizontal when the immersed surface is planar and horizontal.

The size of the hydraulic reaction force further depends on the liquid flow generated by the pumping device between each liquid inlet 9 and each liquid outlet 10.

A device according to the invention comprises a control unit 90 which is capable of controlling a modulation of the liquid flow flowing between each liquid inlet 9 and each liquid outlet 10 produced by said pumping device. FIG. 5 schematically sets out the architecture of the control system of a device according to a preferred embodiment of the invention.

The control unit 90 is capable of receiving information from a device for detecting at least one signal, which is called the instruction signal and which represents at least one predetermined state of the device. That device for detecting instruction signals comprises, for example, sensors 91, 92, 93. Those sensors 91, 92, 93 can be sensors for sensing the front wall, rear wall and water line respectively so that activation thereof indicates that the device is in a state blocked at the front against a wall, blocked at the rear against a wall and a state in which the water line is being passed respectively.

A front wall or rear wall sensor may be of any known type. For example, a sensor of this type may be a contact type sensor. Preferably, such a wall sensor is an electronic sensor which is capable of periodically measuring a variable representing the load moment of at least one electric drive motor

20*a*, 20*b* of a drive rolling member 2, 4, and of comparing that value with a predetermined value representing the maximum value permitted. If the value is exceeded, this indicates the device is blocked against a front wall or rear wall in accordance with the direction of advance of the device. A sensor of this type is described in patent application No. FR2864129 by the same Applicant.

The control unit 90 is capable of controlling the power of the electric motor 12 of the pumping device. Preferably, the control unit 90 is also capable of controlling the power of the electric drive motors 20*a*, 20*b* of the drive rolling member 2, 4 which contribute to the driving of the device over the immersed surface.

The control unit 90 of a device according to the invention may be programmed so as to confer various functionalities on the device according to the invention. The control unit 90 has the feature of being able to modulate the power of the pumping device, which allows the energy consumption levels of the device to be limited and optimization of operations for passing obstacles, traveling up and down walls and, in general, the handling of the device.

According to a preferred embodiment of the invention, the driving of the device follows the method described below.

In a first step, the electric motor 12 of the pumping device is actuated. In a following step, the drive motors 20*a*, 20*b* of the drive rolling members 2, 4 are also activated in such a manner that, in a following step, the device moves over the immersed surface on which it has been positioned. A timer, which is called a trajectory timer and which has a predetermined duration dependent in particular on the immersed surface to be cleaned, is then actuated. In a following step, a specific procedure for changing direction is initiated if the timer reaches the expiry point without the device encountering the slightest obstacle.

If, however, during the movement of the device over the immersed surface, a vertical or substantially vertical obstacle is detected by a sensor of the device, called a wall sensor, for example, an electronic sensor, which is capable of detecting a variation in inclination, a dedicated timer, which is called a wall timer and which has a predetermined duration, for example, 10 seconds, is actuated. That wall sensor is monitored for the entire duration of the wall timer. If the inclination timer indicates that the device has returned to the horizontal, this is because the obstacle encountered was really a stairway which the device has traveled over. In this instance, the electric traction motors 20*a*, 20*b* are maintained for a predetermined period of time in order to overcome the steps of the stairway. At the end of that predetermined period of time, the electric motors 20*a*, 20*b* are reversed and the power of the pump is reduced to a predetermined value, for example, to 20% of its full power, so as to bring about the return of the device to the pool.

However, so long as the wall sensor is active, that is to say, for example, so long as the inclination sensor indicates an incline, this is because the obstacle is not a step of a stairway, but instead is a vertical wall of the pool.

In this instance, a timer dedicated to climbing walls is actuated and the power of the pump is reduced by a predetermined value, for example, 20%, which allows the device to climb along the wall and to clean the wall whilst limiting energy consumption levels. Once the timer dedicated to cleaning the walls has expired, the power of the pump is reduced to a predetermined value, for example, 50%, of its full power, and the drive motors of the drive members 20*a*, 20*b* are stopped. The device will naturally return to the bottom of the pool. The device will follow a procedure for changing direction similar to that described below and resume normal intake on the bottom of the pool.

Such a procedure for changing direction may, for example, comprise the following steps. In a first step, the power of the pump is reduced as far as a predetermined value, for example, to 20% of its full power. In a following step, the drive motors 20*a*, 20*b* of the drive rolling members are reversed for a predetermined period of time, for example, of five seconds. In a following step, a rotation through a predetermined angle, for example, 120°, is carried out. To that end, if the device comprises two front drive wheels 2 which are driven by two electric motors 20*a*, 20*b*, respectively, those electric motors 20*a*, 20*b* are actuated in opposing manners so that the device pivots partially about itself through the predetermined angle. In a following step, the pump is brought to its full power and the intake of debris may resume its course and the device may follow a new trajectory. In a final step, the trajectory timer is restarted. The predetermined angle which defines the rotation of the device may be selected from the range between 90° and 180°. The end-points of this range are excluded, given that the value 90° would result in the device following the vertical wall and the value 180° would position the device on the trajectory from which it came, which is unsatisfactory. The angle may be an angle to the right or to the left of the device and such that the device may leave in any direction with the exception of the direction from which it came.

Naturally, a control method of a device according to the invention may have a large number of variants without departing from the scope of the invention. The main feature is that the control unit can modulate the power of the pump in a given number of specific situations, which allows optimization of the performance levels, whilst limiting the energy requirements of the device. In particular, a device according to the invention allows use of standard traction motors which have average performance levels and which are of low cost, without thereby impairing the performance levels of the device. Similarly, the device for detecting the instruction signals representing predetermined states of the device may have a number of variants so as to allow detection of states of the device which have not been described.

It has been found that a device according to the invention which has an overall height of 250 mm and which is provided with a pumping motor having power of 80 W can produce a liquid flow in the order of 18 $m^3$/h. The total power consumed for operation of that device which is driven at a mean speed in the order of 10 m/min is in the order of 85 W. By comparison, a device according to WO 0250388 which is provided with the same pumping motor and which has the same height produces a flow in the order of 15 $m^3$/h. Furthermore, the total power consumed for operation of this prior device driven at the same mean speed is in the order of 105 W. Therefore, it is found that a device according to the invention has an improvement in the order of 20% in terms of its performance levels in comparison with a prior device comparable with WO 0250388.

The invention claimed is:

1. A rolling device for cleaning an immersed surface comprising:

a hollow body, rolling members having contact zones with the immersed surface, defining a rolling plane of the hollow body over the immersed surface, at least one motor for driving at least one rolling member, called the drive rolling member, in order to form a driving device which is capable, via this/these drive rolling member(s), of moving the hollow body over the immersed surface in at least one direction of advance and in a main direction of advance, called the longitudinal direction, a filtration chamber in the hollow body, comprising:

at least one liquid inlet into the hollow body, located at the base of said hollow body, at least one liquid outlet out of the hollow body, located remotely from the base of said hollow body, at least one hydraulic circuit for flow of liquid between at least one liquid inlet and at least one liquid outlet through at least one filtering device, at least one motorized pumping device which is at least partially interposed in a hydraulic circuit and which is capable of producing a flow of liquid between each liquid inlet and each liquid outlet which are connected by that hydraulic circuit, at least one liquid outlet which is called the rear outlet being orientated towards the rear in such a manner that the liquid flow which is discharged via that rear outlet produces, by means of reaction, forces whose resultant, called the hydraulic reaction force, has a longitudinal component for driving the device forwards which is not equal to zero, wherein it comprises:

a device for detecting at least one signal, which is called an instruction signal and said instruction signal being a predetermined state of the device, a control unit which is capable of controlling modulation of the liquid flow which is discharged from at least one rear liquid outlet, said modulation having the effect of modulating said hydraulic reaction force and said longitudinal drive component brought about by the flow of liquid which is discharged from said at least one rear outlet, in accordance with the value of at least one instruction signal detected by said detection device.

2. A device as claimed in claim 1, wherein said control unit is capable of controlling a modulation of the liquid flow which is pumped by the pumping device and which flows between each liquid inlet and each rear liquid outlet.

3. A device as claimed in claim 1, wherein said control unit is capable of controlling a modulation of the liquid flow which is discharged from at least one rear liquid outlet in such a manner that said flow has a value selected from at least two separate values different from a zero flow rate.

4. A device as claimed in claim 3, wherein the control unit is capable of controlling modulation of the liquid flow which is discharged from at least one rear liquid outlet in such a manner that the flow has a value selected from: a maximum flow value, a value in the order of 50% of the maximum flow and a value in the order of 20% of the maximum flow.

5. A device as claimed in claim 1, wherein said pumping device comprises an electric pumping motor, and said control unit is capable of modulating the power of the electric pumping motor so as to modulate the liquid flow flowing between each liquid inlet and each rear liquid outlet which allows modulation of the hydraulic reaction force.

6. A device as claimed in claim 1, wherein at least one rear outlet is orientated in such a manner that said hydraulic reaction force has a component, which is called the vertical component and which is not zero, for driving the device towards the immersed surface.

7. A device as claimed in claim 6, wherein the axis of rotation of the pumping propeller is inclined relative to the longitudinal direction and extends in a longitudinal plane which is orthogonal to the rolling plane.

8. A device as claimed in claim 1, wherein said control unit is capable of modulating the hydraulic reaction force by modulating the liquid flow pumped by the pumping device when the device climbs along a vertical wall so as to limit the ascent speed of the device.

9. A device as claimed in claim 1, wherein said control unit is capable of modulating the hydraulic reaction force by modulating the liquid flow pumped by the pumping device when the device is at the water line so as to allow the device to descend towards the immersed surface opposite the water line.

10. A device as claimed in claim 1, wherein said control unit is capable of modulating the hydraulic reaction force by modulating the liquid flow which is discharged from at least one rear liquid outlet so as to bring about, when each drive rolling member of the device is disengaged from the immersed surface, a pivoting moment of the device about an axis parallel with the rolling plane which tends to return each drive rolling member of the device into contact with the immersed surface.

11. A device as claimed in claim 1, wherein said control unit is also capable of controlling each drive motor (20*a*, 20*b*) of each drive rolling member.

12. A device as claimed in claim 1, wherein it comprises a front axle which carries at least one drive rolling member which is mounted for rotation relative to the hollow body about a transverse axis.

13. A device as claimed in claim 12, wherein the front axle carries two drive rolling members which are mounted at each of the ends of the axle, respectively, each drive rolling member being driven in rotation by an electric drive motor.

14. A device as claimed in claim 1, wherein said detection device comprises at least one wall sensor which is connected to the control unit and which is capable of detecting the presence of a vertical wall.

15. A method for controlling a device for cleaning an immersed surface according to claim 1, wherein:

at least one motorized pumping device of the device is actuated, at least one drive motor of at least one rolling member of the device is actuated, wherein the power of the pumping device is modulated at the control of a control unit as soon as a signal, called the instruction signal, is detected by a device for detecting a signal representing a predetermined state of the device.

* * * * *